US011382483B2

(12) United States Patent
Kim et al.

(10) Patent No.: US 11,382,483 B2
(45) Date of Patent: Jul. 12, 2022

(54) DISHWASHER

(71) Applicant: LG Electronics Inc., Seoul (KR)

(72) Inventors: Ilhwan Kim, Seoul (KR); Seunghun Kim, Seoul (KR); Sangwoo Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 109 days.

(21) Appl. No.: 16/968,453

(22) PCT Filed: Feb. 8, 2019

(86) PCT No.: PCT/KR2019/001567
§ 371 (c)(1),
(2) Date: Aug. 7, 2020

(87) PCT Pub. No.: WO2019/156501
PCT Pub. Date: Aug. 15, 2019

(65) Prior Publication Data

US 2020/0397210 A1 Dec. 24, 2020

(30) Foreign Application Priority Data

Feb. 8, 2018 (KR) ..... 10-2018-0015783

(51) Int. Cl.
*A47L 15/00* (2006.01)
*A47L 15/42* (2006.01)

(52) U.S. Cl.
CPC ..... *A47L 15/0015* (2013.01); *A47L 15/4214* (2013.01); *A47L 15/4234* (2013.01); *A47L 15/4278* (2013.01)

(58) Field of Classification Search
None
See application file for complete search history.

(56) References Cited

U.S. PATENT DOCUMENTS 7,699,937 B2 * 4/2010 Kim ..... A47L 15/4234 134/25.2

* cited by examiner

*Primary Examiner* — Rita P Adhlakha
(74) *Attorney, Agent, or Firm* — Fish & Richardson P.C.

(57) ABSTRACT

A dishwasher is proposed. The dishwasher includes a case accommodating a cleaning target therein, a sump connected to an interior of the case to collect wash water, a wash pump into which the wash water flows from the sump, and generating steam, a steam nozzle into which the steam flows from the wash pump, and spraying the steam into the case, and a bubble filter disposed on a steam path between the wash pump and the steam nozzle to remove a bubble in the steam path.

10 Claims, 10 Drawing Sheets

DISHWASHER

CROSS-REFERENCE TO RELATED APPLICATIONS

This application is a National Stage application under 35 U.S.C. § 371 of International Application No. PCT/KR2019/001567, filed on Feb. 8, 2019, which claims the benefit of Korean Application No. 10-2018-0015783, filed on Feb. 8, 2018. The disclosures of the prior applications are incorporated by reference in their entirety.

TECHNICAL FIELD

The present disclosure relates to a dishwasher and, more particularly, to a dishwasher that washes dishes or cooking utensils by spraying wash water and steam.

BACKGROUND ART

A dishwasher is a home appliance that washes dishes or cooking utensils, etc. (hereinafter referred to as a 'cleaning target') to remove waste such as food residues therefrom by high-pressure wash water sprayed from a spray arm.

The dishwasher washes the cleaning target using heated wash water or performs a washing operation or a sterilizing operation by supplying steam to the cleaning target. A structure where a heater is installed in a wash pump to efficiently generate steam has been proposed. In addition, a structure where a steam nozzle for spraying steam is disposed on a lower end of a door so that steam is efficiently applied to the cleaning target has been proposed (Korean Patent Laid-Open Publication No. 10-2017-0016180).

When steam is generated, bubbles surrounding gas-phase steam with liquid-phase water in the form of a thin film are created. There is a problem that a flow velocity in the steam path is reduced, while the bubbles created as such move along a steam path together with the steam.

Furthermore, there is a problem that the bubbles are burst while the bubbles move along the steam path, so that resistance in the steam path is increased and consequently an amount of the steam sprayed from the steam nozzle is reduced.

DISCLOSURE

Technical Problem

The present disclosure proposes a dishwasher that removes bubbles flowing along a steam path, thus increasing an amount of steam sprayed from a steam nozzle.

Furthermore, the present disclosure proposes a dishwasher that separates water and steam in a steam path, thus securing the straightness of steam sprayed from a steam nozzle and improving visibility when the steam is sprayed.

Furthermore, the present disclosure proposes a dishwasher configuration in which a filter for removing bubbles in a steam path is disposed to achieve the maximum effect.

Technical objects to be achieved by the present disclosure are not limited to the aforementioned technical objects, and other technical objects not described above may be evidently understood by a person having ordinary skill in the art to which the present disclosure pertains from the following description.

Technical Solution

A dishwasher according to an embodiment of the present disclosure may include a case accommodating a cleaning target therein; a sump connected to an interior of the case to collect wash water; a wash pump into which the wash water flows from the sump, and generating steam; a steam nozzle into which the steam flows from the wash pump, and spraying the steam into the case; and a bubble filter disposed on a steam path between the wash pump and the steam nozzle to remove a bubble in the steam path.

The bubble filter may include a bubble chamber configured such that a first end thereof is located to be higher than a water level in the wash pump, and a second end thereof is located to be lower than the water level in the wash pump, while the dishwasher is operated in a steam spray mode, and a bubble breaker disposed in the bubble chamber to break the bubble.

The bubble breaker may be disposed higher than the water level in the wash pump, while the dishwasher is operated in the steam spray mode.

Furthermore, the bubble breaker may include a plurality of breaking plates extending in a direction where the steam flows in the bubble chamber. The plurality of breaking plates may be arranged such that neighboring breaking plates face each other, with a steam flow space being formed between the neighboring breaking plates.

According to an embodiment of the present disclosure, the bubble breaker may form the steam flow space between a breaking plate adjacent to an inner surface of the valve chamber among the plurality of breaking plates and the inner surface of the valve chamber.

According to an embodiment of the present disclosure, the bubble breaker may include a pair of guide protrusions on both sides thereof that face each other.

The bubble chamber may include a pair of guide grooves into which the pair of guide protrusions is inserted, so that the bubble breaker may be slidably coupled to the bubble chamber.

According to an embodiment of the present disclosure, the bubble breaker may include a first connecting plate connecting first sides of the plurality of breaking plates to each other, and a second connecting plate connecting second sides of the plurality of breaking plates to each other. Each of the first connecting plate and the second connecting plate may include a guide protrusion.

According to an embodiment of the present disclosure, the bubble chamber may include a bubble-chamber upper member and a bubble-chamber lower member. The bubble breaker may be disposed between a bubble-chamber upper member and a bubble-chamber lower member. Furthermore, the bubble breaker may be supported upwards by the bubble-chamber lower member, and be supported downwards by the bubble-chamber upper member.

According to an embodiment of the present disclosure, the dishwasher may further include a steam hose connecting the bubble filter and the steam nozzle. The bubble filter may be coupled at a first end thereof to the wash pump, and coupled at a second end thereof to the steam hose.

According to an embodiment of the present disclosure, the bubble filter may be disposed on a base of the case, on which the sump and the wash pump are disposed.

Specific details of other embodiments are included in the detailed description and drawings.

Advantageous Effects

A dishwasher according to the present disclosure has one or more effects as follows.

First, it is advantageous in that only steam moves to a steam nozzle by removing bubbles flowing along a steam path, thus increasing an amount of the steam sprayed from a steam nozzle.

Second, it is advantageous in that water and steam in a steam path are separated, so that flow resistance in the steam path is reduced, thus securing the straightness of steam sprayed from a steam nozzle and improving visibility when the steam is sprayed.

Third, it is advantageous in that a bubble filter is coupled to a wash pump in which steam is generated, so that the bubble filter can effectively remove bubbles in a beginning part of a steam path.

Effects which may be obtained by the present disclosure are not limited to the aforementioned effects, and other technical effects not described above may be evidently understood by a person having ordinary skill in the art to which the present disclosure pertains from the following description.

MODE FOR INVENTION

Figure 1:
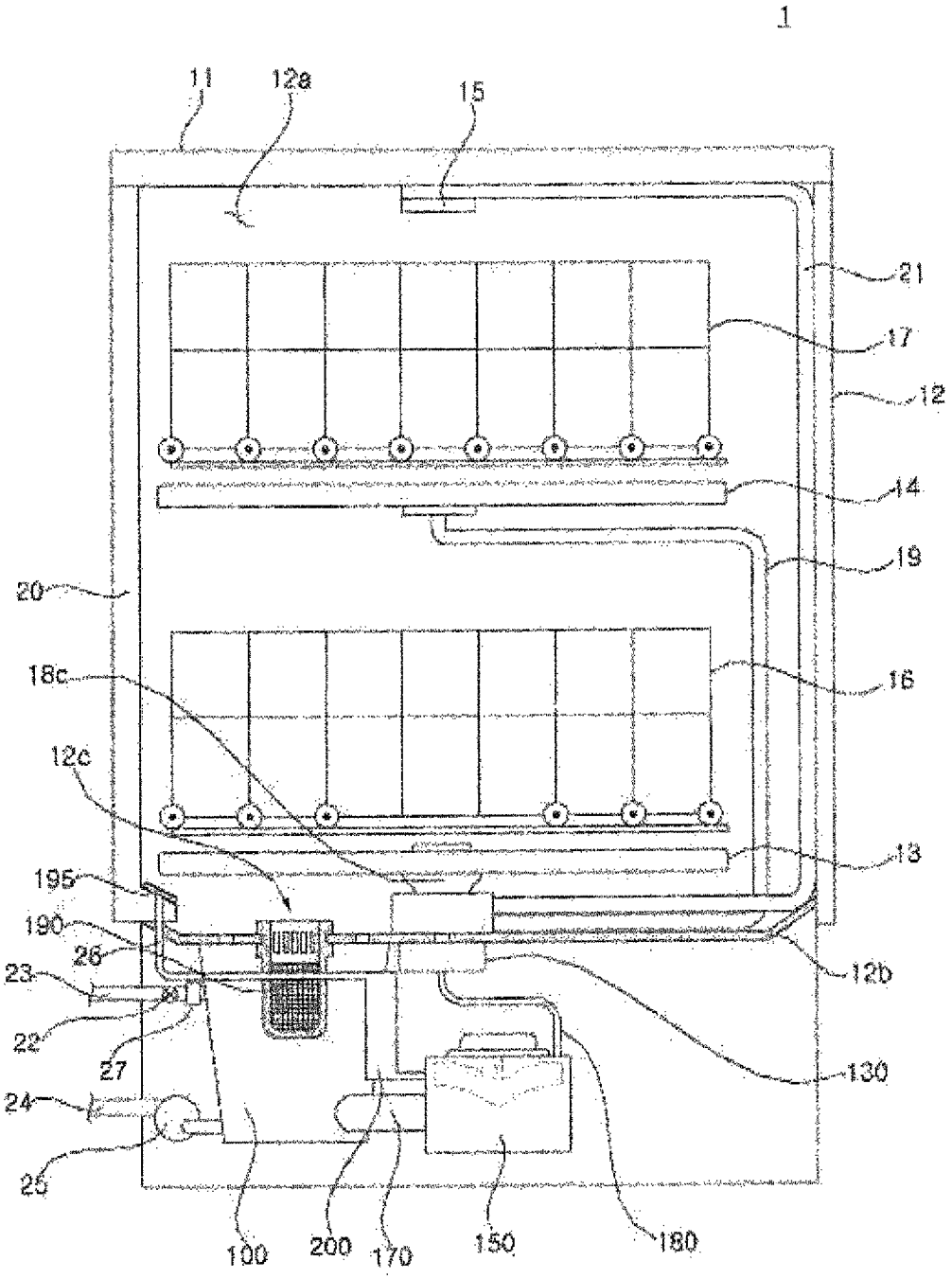
FIG. 1 is a diagram illustrating a schematic structure of a dishwasher in accordance with an embodiment of the present disclosure.

The above and other objects, features and other advantages of the present disclosure will be more clearly understood from the following detailed description when taken in conjunction with the accompanying drawings. However, it is to be understood that the present disclosure may be embodied in many different forms without being limited to embodiments which will be described later. These embodiments are intended to make the disclosure of the invention complete. The present disclosure will be described to be understood by a person having ordinary skill in the art to which the present disclosure pertains.

Hereinafter, the terms "front (F)/rear (R)/left (Le)/right (Ri)/up (U)/down (D)" may be defined as shown in the drawings. However, they are merely used for the convenience of description. The terms "front (F)/rear (R)/left (Le)/right (Ri)/up (U)/down (D)" may be defined differently from those designated in the drawings.

FIG. 1 is a diagram illustrating a schematic structure of a dishwasher in accordance with an embodiment of the present disclosure.

Figure 2:
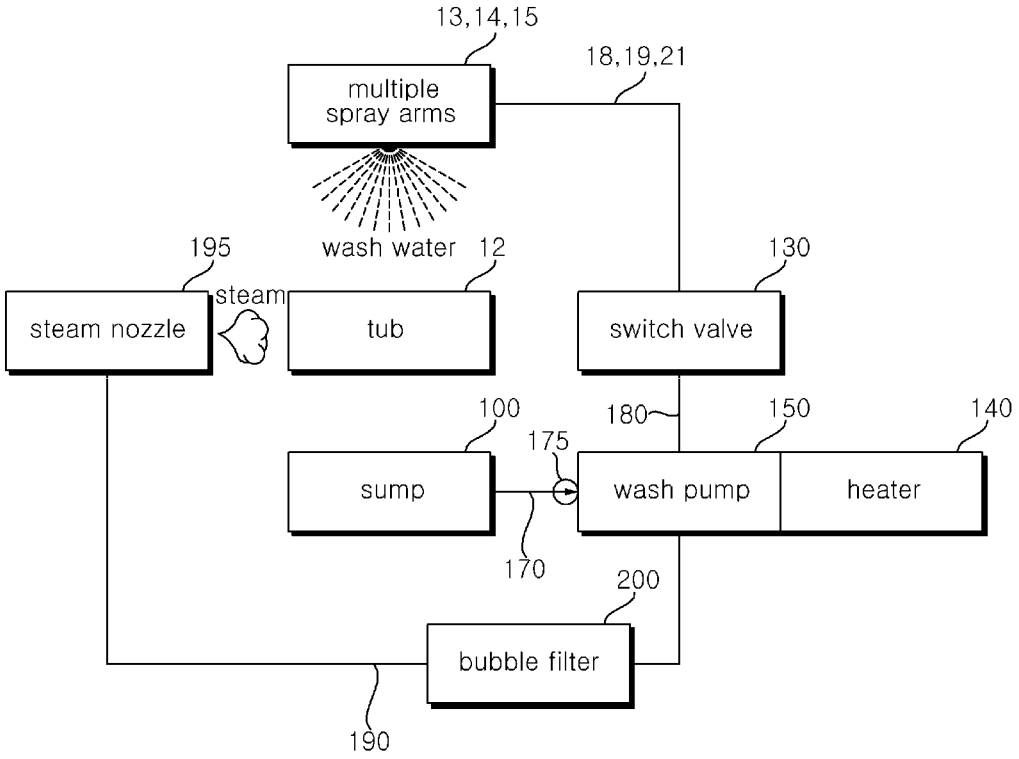
FIG. 2 is a diagram illustrating a configuration of the dishwasher in accordance with the embodiment of the present disclosure.

FIG. 2 is a diagram illustrating a configuration of the dishwasher in accordance with the embodiment of the present disclosure.

The dishwasher 1 in accordance with the embodiment of the present disclosure a case 11 which defines an appearance thereof, a tub 12 which is provided in the case 11 and defines a wash chamber 12*a* accommodating a cleaning target therein, a door 20 which is provided on a front of the tub 12 to open or close the wash chamber 12*a*, a sump 100 which is disposed under the tub 12 to store wash water, a plurality of spray arms 13, 14, and 15 which sprays wash water into the tub 12, a wash pump 150 which supplies the wash water stored in the sump 100 to the plurality of spray arms 13, 14, and 15 to generate steam, a steam nozzle 195 which sprays the steam generated in the wash pump 150 to the wash chamber 12*a*, a bubble filter 200 which is disposed on a steam path between the wash pump 150 and the steam nozzle 195 to remove bubbles in the steam path, a steam hose 190 which connects the wash pump 150 and the steam nozzle 195 or the bubble filter 200 and the steam nozzle 195, and a switch valve 130 which is disposed on the sump 100 to distribute wash water to the plurality of spray arms 13, 14, and 15.

The case 11 may accommodate dishes which are the cleaning target. The case 11 may accommodate the tub 12 and all of components of the dishwasher 1.

The tub 12 is formed in the shape of a hexahedron which is opened at the front, and defines a wash chamber 12*a* therein. A communication hole 12*c* is formed in a bottom 12*b* of the tub 12 so that wash water flows into the sump 100. The wash chamber 12*a* is provided with a plurality of racks 16 and 17 to receive the cleaning target. The plurality of racks 16 and 17 includes a lower rack 16 disposed in a lower portion of the wash chamber 12*a*, and an upper rack 17 disposed in an upper portion of the wash chamber. The lower rack 16 and the upper rack 17 may be vertically disposed to be spaced apart from each other, and may be taken out from the tub 12 by sliding forwards.

The plurality of spray arms 13, 14, and 15 is vertically disposed. The plurality of spray arms 13, 14, and 15 includes a lower spray arm 13 which is disposed on a lowermost portion to spray wash water towards the lower rack 16 from bottom to top, an upper spray arm 14 which is disposed above the lower spray arm 13 to spray wash water towards the upper rack 17 from bottom to top, and a top spray arm 15 which is disposed on an upper end of the wash chamber 12*a* that is an upper side of the upper spray arm 14 to spray wash water from top to bottom.

The plurality of spray arms 13, 14, and 15 is supplied with wash water through a plurality of spray arm connecting paths 18, 19, and 21 from the wash pump 150. The plurality of spray arm connecting paths 18, 19, and 21 includes a lower spray arm connecting path 18 connected to the lower spray arm 13, an upper spray arm connecting path 19 connected to the upper spray arm 14, and a top spray arm connecting path 21 connected to the top spray arm 15.

The sump 100 is disposed under the bottom 12*b* of the tub 12 to collect the wash water. The sump 100 is connected to a water supply path 23 through which the wash water supplied from an external water source flows. A water supply valve 22 is provided on the water supply path 23 to regulate the wash water supplied from the external water source. If the water supply valve 22 is opened, the wash water supplied from the external water source flows through the water supply path 23 into the sump 100. A flowmeter 27 is provided on the water supply path 23 to measure the flow rate of the wash water flowing through the water supply path 23 to the sump 100.

The sump 100 is connected to a drain path 24 which guides the stored wash water to an outside of the dishwasher 1. A drain pump 25 is provided on the drain path 24 to drain the wash water in the sump 100 through the drain path 24. If the drain pump 25 is driven, the wash water stored in the sump 100 flows through the drain path 24 to the outside of the case 11.

A filter 26 is mounted in the communication hole 12*c* to filter waste from the wash water which flows from the tub 12 to the sump 100.

The wash pump 150 supplies the wash water stored in the sump 100 to at least one of the plurality of spray arms 13, 14, and 15. The wash pump 150 is connected to the switch valve 130 via a wash-water supply path 180. If the wash pump 150 is driven, the wash water stored in the sump 100 flows through a water collecting path 170 into the wash pump 150, and then is pumped through the wash-water supply path 180 to the switch valve 130.

The wash pump 150 may heat the wash water transferred to the wash-water supply path 180. The wash pump 150 heats the wash water stored therein to generate steam. The wash pump 150 is connected to the steam hose 190. The steam generated in the wash pump 150 is supplied through the steam hose 190 to the steam nozzle 195.

The wash pump 150 is installed on aside of the sump 100. Since the wash pump 150 may use any one of conventional known pumps, a detailed description of the wash pump 150 will be omitted herein.

The heater 140 is coupled to a lower side of the wash pump 150 to heat the wash water in the wash pump 150. The heater 140 heats the wash water flowing in the wash pump 150 when the wash pump 150 is operated, thus generating hot water. The heater 140 heats the wash water stored in the wash pump 150 when the wash pump 150 is stopped, thus generating steam.

The hot water generated by the heater 140 is sprayed into the tub 12 through at least one of the plurality of spray arms 13, 14, and 15. The steam generated by the heater 140 flows along the steam hose 190 and then is discharged through the steam nozzle 195 into the tub 12.

The bubble filter 200 may be disposed on the steam path between the wash pump 150 and the steam nozzle 195. The bubble filter 200 may include a bubble chamber 210, 220 which holds the steam and the wash water therein, and a bubble breaker 230 which is disposed in the bubble chamber 210, 220 to break the bubble. The bubble filter 200 may break the bubble passing through the bubble filter 200, so that water in the liquid phase may be accumulated in the bubble chamber 210, 220, and steam in the gas phase may flow along the steam path into the steam nozzle 195. The bubble filter 200 will be described later in detail with reference to FIG. 3 and the like.

The steam nozzle 195 is provided on the lower end of the door 20 to spray the steam to the wash chamber 12*a*. The steam sprayed from the steam nozzle 195 acts on the cleaning target received in the lower rack 16 and/or the upper rack 17.

The switch valve 130 selectively connects the sump 100 to at least one of the plurality of spray arms 13, 14, and 15. The switch valve 130 selectively supplies the wash water pumped by the wash pump 150 to at least one of the lower spray arm 13, the upper spray arm 14, and the top spray arm 15. The switch valve 130 selectively connects the wash-water supply path 180 to at least one of the plurality of spray arm connecting paths 18, 19, and 21.

A check valve 175 is disposed between the sump 100 and the wash pump 150 to be opened in a direction from the sump 100 to the wash pump 150. The check valve 175 is opened so that the wash water flows from the sump 100 to the wash pump 150, and is closed so that the steam does not flow from the wash pump 150 to the sump 100. A lower portion of the check valve 175 rotates about an upper portion, so that the check valve is opened. The check valve 175 is disposed in the water collecting path 170 or connects the water collecting path 170 and the wash pump 150 to open or close the water collecting path 170.

The check valve 175 is closed when the heater 140 generates the steam. The check valve 175 is opened when the wash pump 150 is operated, so that the wash water flows, and is closed when the wash pump 150 is stopped, so that the wash water does not flow. The check valve 175 is opened by the flow pressure of the wash water of the wash pump 150. According to an embodiment, the check valve 175 may be a solenoid valve that is opened or closed by an electronic signal.

The check valve 175 is formed so that the wash water flows from the wash pump 150 to the sump 100, even when the check valve is closed during the operation of the drain pump 25.

Figure 3:
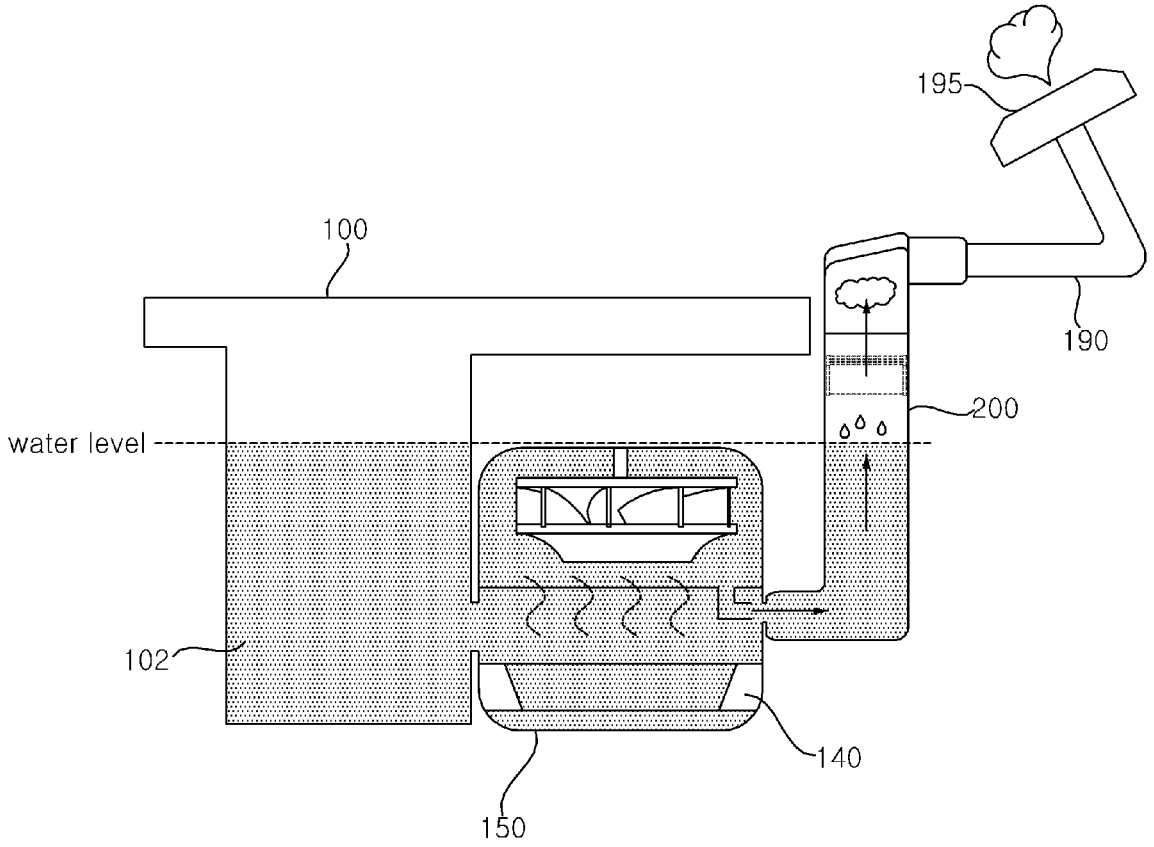
FIG. 3 is a schematic view illustrating the steam spray of the dishwasher in accordance with the embodiment of the present disclosure.

FIG. 3 is a schematic view illustrating the steam spray of the dishwasher in accordance with the embodiment of the present disclosure.

Referring to FIG. 3, the wash pump 150 may be connected to a water collector 102 of the sump 100 via a water collecting pipe, so that water may be introduced from the water collector 102.

The bubble chamber 210, 220 may be coupled at a lower end to the wash pump 150, so that wash water and/or steam may be introduced from the wash pump 150. The bubble chamber 210, 220 may be connected to a negative-pressure part of the wash pump 150.

The negative-pressure part of the wash pump 150 is a part in which negative pressure is generated when a pump motor is operated, and may be defined as a part which stores wash water introduced into a wash motor. The negative-pressure part of the wash pump 150 may be distinguished from a positive-pressure part of the wash pump 150 which discharges the wash water pumped by the wash pump 150.

Meanwhile, although not shown in the drawings, the bubble filter 200 may not be directly connected to the wash pump 150, but may be connected thereto via a hose.

If water is accommodated in the water collector 102 of the sump 100, water may also be accommodated in the wash pump 150 and the bubble filter 200 connected to the wash pump 150. In this case, a water level in the wash pump 150 and the bubble filter 200 may be the same as a water level of the water collector 102.

The bubble filter 200 may include the bubble breaker 230, and the bubble chamber 210, 220 defining internal space in which wash water is accommodated.

While the dishwasher 1 is operated in a steam spray mode, one end (upper end) of the bubble chamber 210, 220 may be located to be higher than the water level in the wash pump 150, and the other end (lower end) may be located to be lower than the water level in the wash pump 150. In other words, the bubble chamber 210, 220 may accommodate the wash water up to a medium height in the chambers.

The heater 140 may heat wash water in a state where the wash water is accommodated in the wash pump 150, thus generating steam. The generated steam may be introduced into the bubble filter 200. Alternatively, steam may be generated in the bubble filter 200 by the heat generated by the heater 140.

For example, if the heater 140 is turned on in a state where wash water is accommodated in the bubble filter 200, the wash water in the wash pump 150 as well as the wash water in the bubble filter 200 may be heated. If the wash water in the wash pump 150 first reaches 100 degrees Celsius to generate steam, the steam may flow through the discharge pipe of the wash pump 150 to the bubble filter 200. At this time, the bubble may be introduced from the wash pump 150 to the bubble filter 200.

For example, if the heater 140 is turned on in a state where wash water is accommodated in the bubble filter 200, so that the wash water in the bubble filter 200 reaches 100 degrees Celsius, steam may be generated in the bubble filter 200. At this time, bubbles surrounding the steam with liquid-phase water may be generated together.

The steam and/or bubble generated in the bubble filter 200 or introduced into the bubble filter 200 may flow along the bubble filter 200.

The steam may flow along the steam path. The steam path may include the bubble chamber 210, 220, the steam path, and a path in the steam nozzle, and may be defined to refer to all passages through which the steam passes.

The bubble breaker 230 may be disposed in the bubble chamber 210, 220 to be higher than the wash water. While the dishwasher 1 is operated in the steam spray mode, the bubble breaker 230 may be disposed in the bubble chamber 210, 220 to be higher than the level of the wash water in the bubble chamber 210, 220.

The bubble breaker 230 may break the bubble which is introduced into the bubble breaker 230 while flowing along the bubble chamber 210, 220. The bubble may be defined as a shape of a sphere formed by surrounding air or gas with a thin liquid film. The bubble breaker 230 may break the bubble so that gas (or air) in liquid comes out of the bubble.

The bubble breaker 230 may break the bubble by causing the bubble to come into contact with a contact surface of the bubble breaker 230.

The bubble breaker 230 may break the bubble, so that the gas-phase steam may pass through the bubble breaker 230 and the liquid-phase water may not pass through the bubble breaker 230.

The steam passing through the bubble breaker 230 may flow to the upper end of the bubble chamber 210, 220 to be discharged through a bubble-chamber outlet 211 to the steam hose 190.

The steam hose 190 may connect the bubble filter 200 and the steam nozzle 195, thus guiding the steam discharged from the bubble filter 200 to the steam nozzle 195.

The steam nozzle 195 may spray the steam into the wash chamber 12*a*.

The bubble filter 200 configured as such may remove the bubble in the steam path, and cause the steam to effectively flow along the steam path, thus improving the flowability of the steam.

In other words, when the steam moves along the steam path in a bubble state, the mobility of the steam may be reduced. When the bubble moving along the steam path is broken and water forms in the steam path, the path resistance of the steam path may be increased.

The bubble filter 200 filters the bubble, generated in the wash pump 150, in the bubble chamber 210, 220 which is a beginning part of the steam path, thus allowing the gas-phase steam to move along the steam path.

Furthermore, the bubble filter 200 configured as such prevents the bubble from being sprayed when the steam is sprayed from the steam nozzle 195, thus allowing the steam to be effectively sprayed.

In other words, if the steam and the bubble are sprayed from the steam nozzle 195 in a mixed state, a spray distance in the tub 12 may be reduced as compared with when only the steam is sprayed. Furthermore, when steam and water drops are mixed and sprayed from the steam nozzle 195, the spray amount of the steam may also be reduced.

The bubble filter 200 may break the bubble in the bubble chamber 210, 220 to capture water drops and cause steam to pass therethrough, so that the spray amount of the steam from the steam nozzle 195 may be increased, and the spray range of the steam may also be enhanced.

Meanwhile, the bubble filter 200 may minimize a curve part of the steam path and thereby minimize a pressure loss.

When the steam hose 190 connects the wash pump 150 and the steam nozzle 195 without the bubble filter 200, the steam hose 190 includes a plurality of bent curve parts. The curved path is a point in which a difference in rotating radius of fluid flowing along the path is large, and may have a larger hydraulic loss compared to a straight path.

Since the bubble filter 200 is connected to the wash pump 150 and steam is created in the bubble filter 200, the flow distance of the steam may be reduced, and in addition, the number of curved paths may be reduced.

By way of example, since a bubble-chamber inlet 221 of the bubble-chamber lower member 220 is formed in a curved path and steam is formed in the middle of the bubble chamber 210, 220, the steam does not pass through the bubble-chamber inlet 221 and the bubble-chamber lower member 220 and the number of the curve parts of the steam path may be reduced.

The dishwasher 1 may be set such that the water level in the water collector 102, the wash pump 150, and the bubble chamber 210, 220 is above a certain height in the steam spray mode. In the state where wash water is stored in the bubble chamber 210, 220, the wash water may be heated by the heater 140, thus generating steam. When the wash water reaches 100 degrees in the bubble chamber 210, 220, the steam may be generated. At this time, the steam may be generated at the surface of the wash water.

Therefore, as the level of the wash water increases, a distance the generated steam moves to the steam nozzle may be reduced. In the state where the level of the wash water in the bubble chamber 210, 220 of the bubble filter 200 is above a certain height, steam may be effectively generated.

Figure 4:
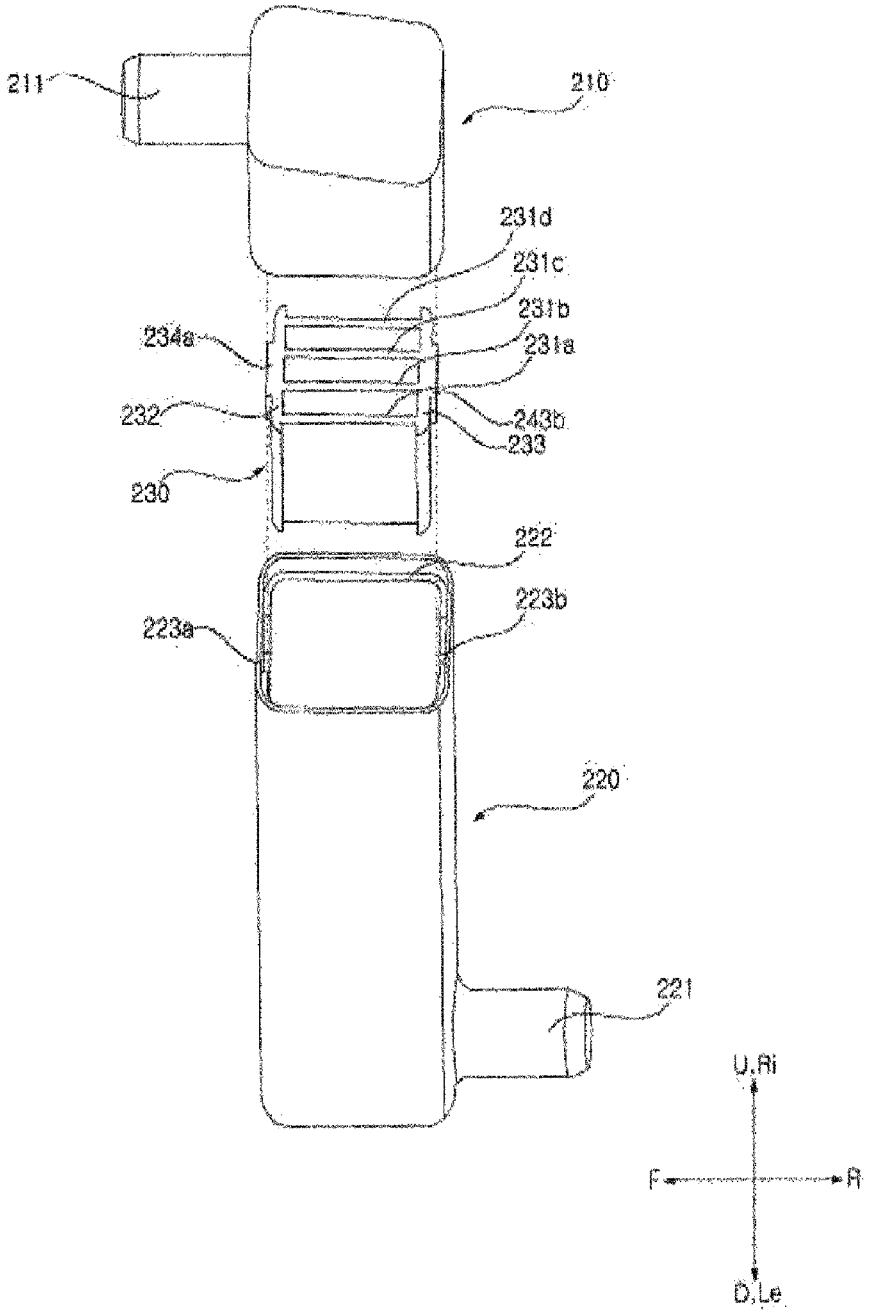
FIG. 4 is an exploded perspective view of a bubble filter of the dishwasher in accordance with the embodiment of the present disclosure.

FIG. 4 is an exploded perspective view of the bubble filter of the dishwasher in accordance with the embodiment of the present disclosure.

Figure 5:
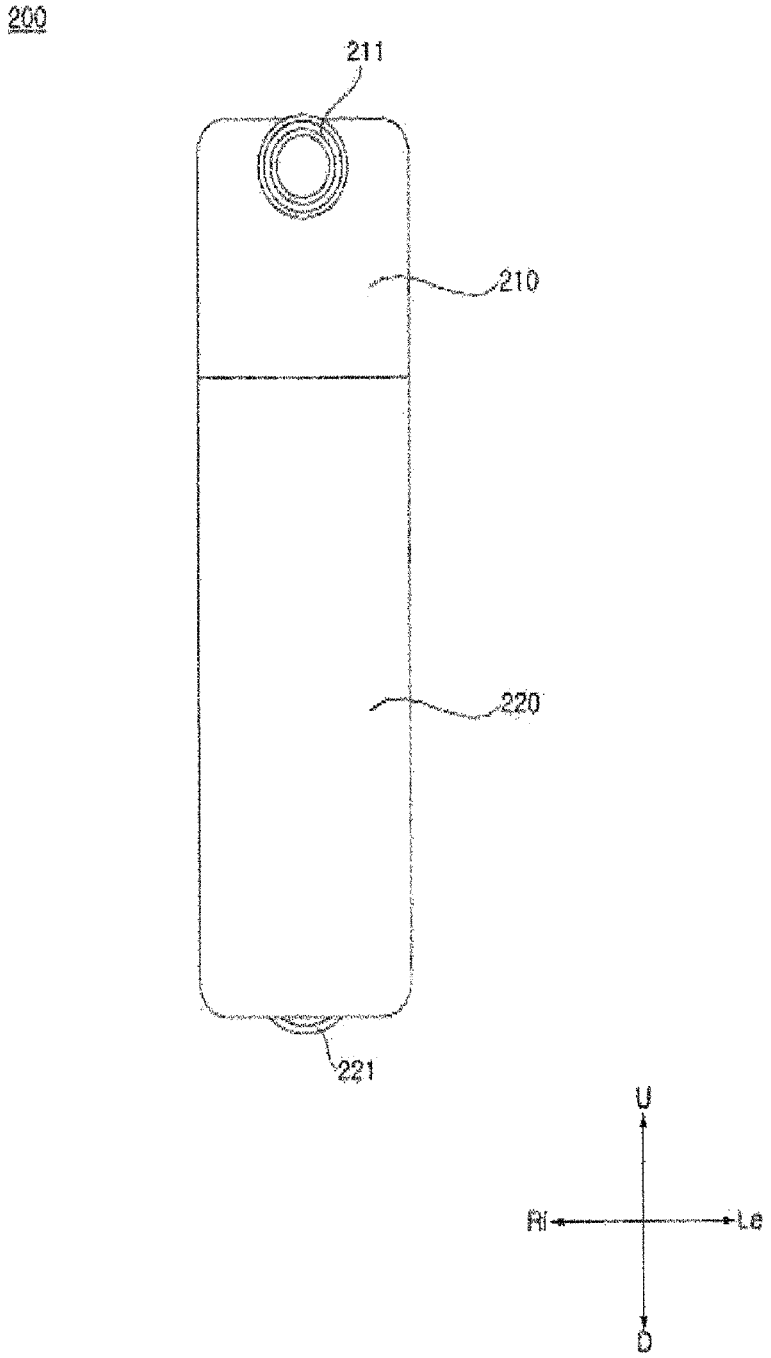
FIG. 5 is a front view of the bubble filter of the dishwasher in accordance with the embodiment of the present disclosure.

FIG. 5 is a front view of the bubble filter of the dishwasher in accordance with the embodiment of the present disclosure.

Figure 6:
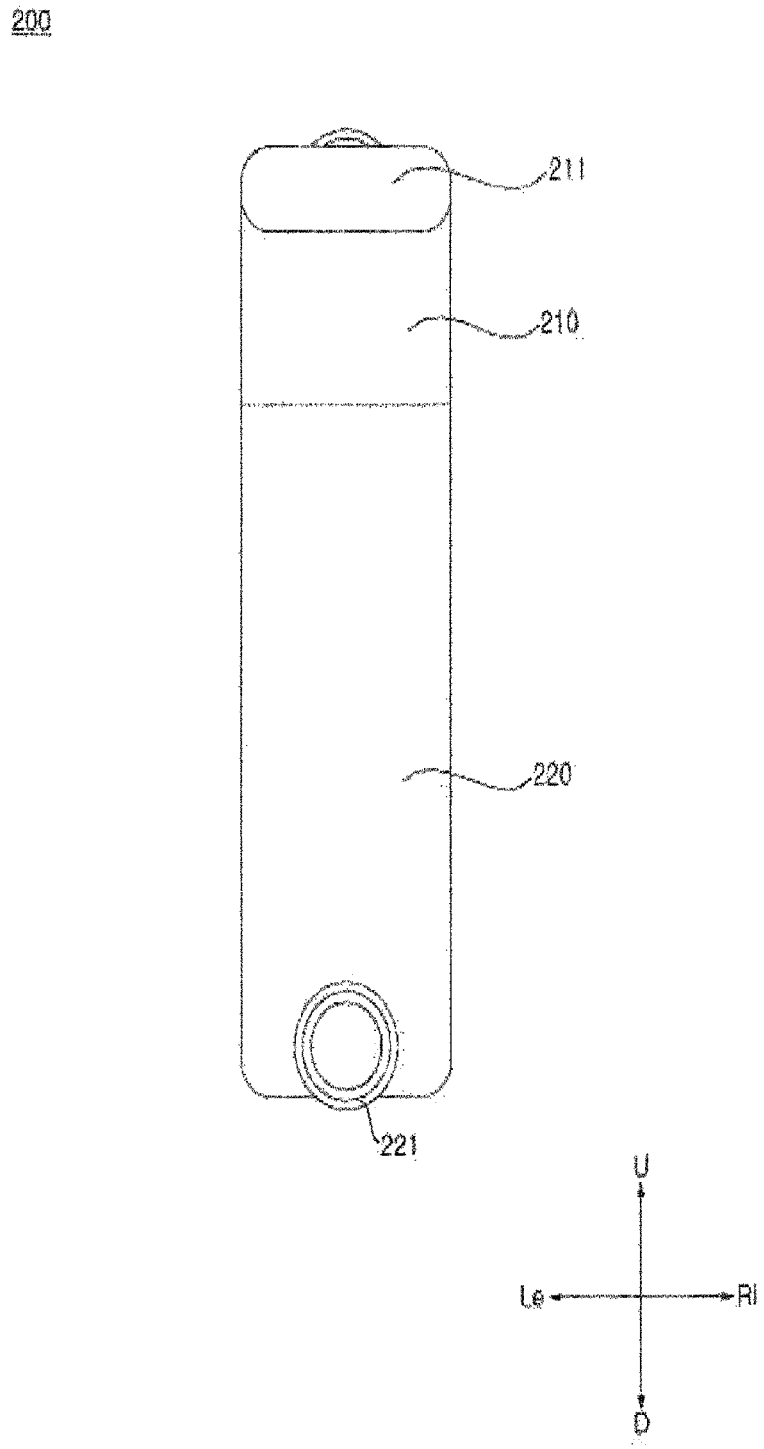
FIG. 6 is a rear view of the bubble filter of the dishwasher in accordance with the embodiment of the present disclosure.

FIG. 6 is a rear view of the bubble filter of the dishwasher in accordance with the embodiment of the present disclosure.

Figure 7:
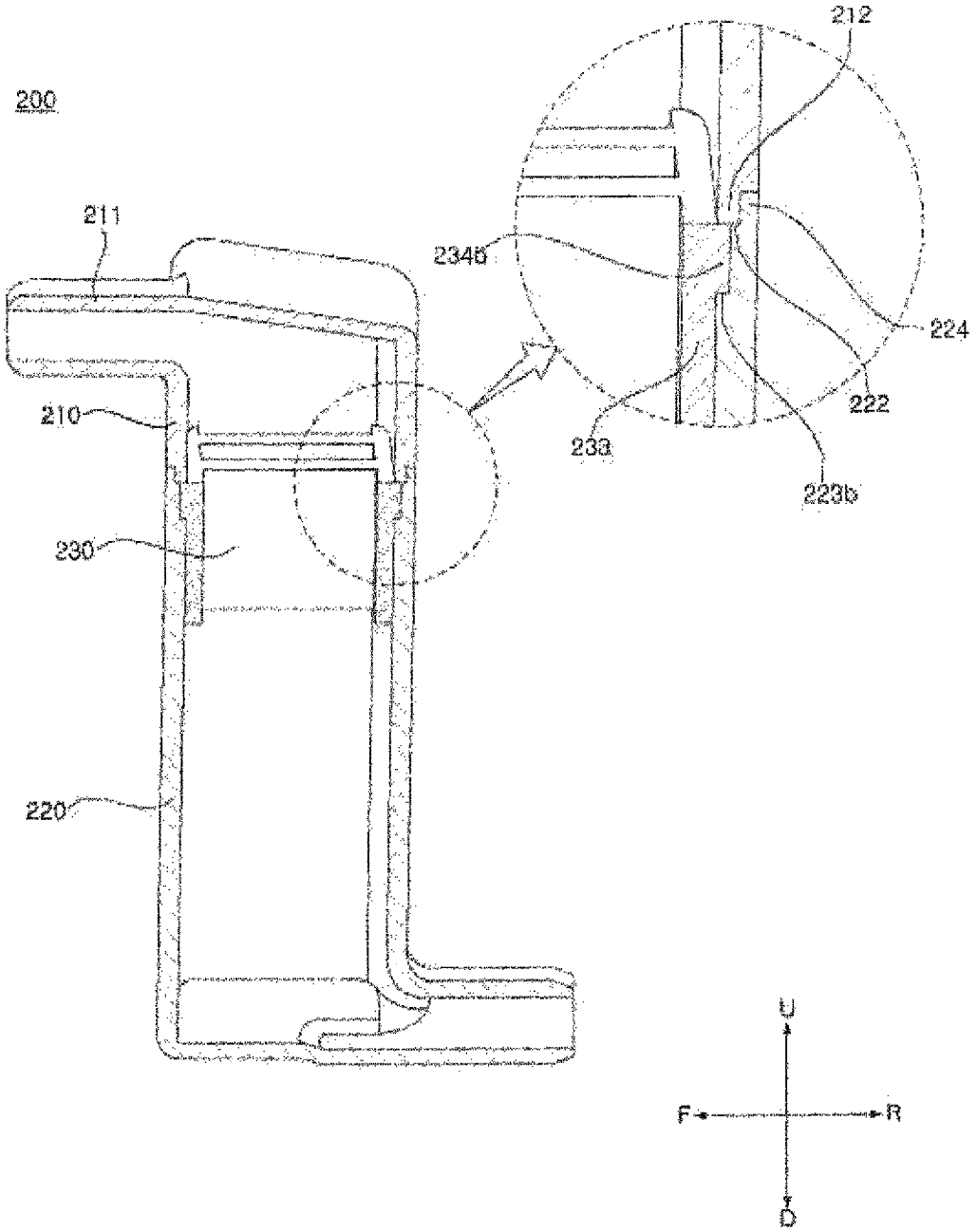
FIG. 7 is a sectional view of the bubble filter of the dishwasher in accordance with the embodiment of the present disclosure.

FIG. 7 is a sectional view of the bubble filter of the dishwasher in accordance with the embodiment of the present disclosure.

Figure 8:
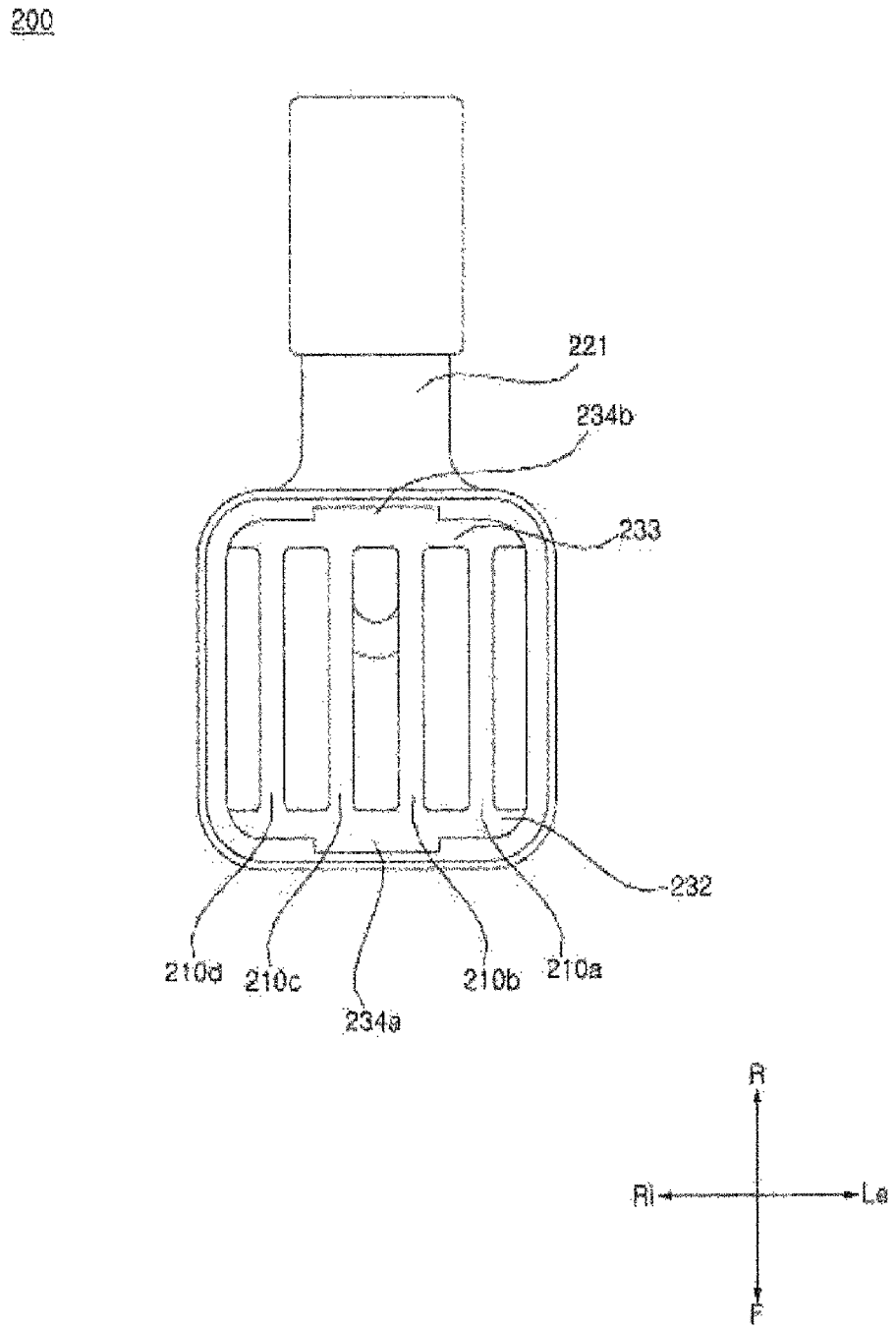
FIG. 8 is a diagram illustrating a bubble-chamber upper member and a bubble breaker of the dishwasher in accordance with the embodiment of the present disclosure, when seen from above.

FIG. 8 is a diagram illustrating a bubble-chamber upper member and the bubble breaker of the dishwasher in accordance with the embodiment of the present disclosure, when seen from above.

Referring to FIG. 4, the bubble filter 200 may include the bubble chamber 210, 220 whose one end is located to be higher than the water level in the wash pump 150 and the other end is located to be lower than the water level in the wash pump 150, while the dishwasher 1 is operated in the steam spray mode. The bubble filter 0 may include the bubble breaker 230 which is disposed in the bubble chamber 210, 220 to break the bubble.

The dishwasher 1 may be operated in any one of the plurality of spray modes including the wash-water spray mode in which wash water is sprayed through the plurality of spray arms 13, 14, and 15, and the steam spray mode in which steam is sprayed through the steam nozzle 195.

The bubble chamber 210, 220 may be generally provided in the shape of a bar that extends vertically to a predetermined length. The bubble chamber 210, 220 may have the shape of a polygonal container that defines a space therein.

The bubble chamber 210, 220 may include the bubble-chamber upper member 210 and the bubble-chamber lower member 220. The bubble-chamber upper member 210 and the bubble-chamber lower member 220 vertically combine each other, thus defining the appearance of the bubble filter 200.

The bubble chamber 210, 220 may be formed of a material having low strain at high temperature. The bubble chamber 210, 220 may be formed of a material that may be resistant to heat, while the wash water contained therein is heated up to 100 degrees by the heater 140. The bubble chamber 210, 220 may be formed of a material whose heat conductivity is a predetermined level or less. The bubble chamber 210, 220 may be formed of a material whose thermal expansion coefficient is a predetermined level or less.

The bubble-chamber upper member 210 may have on a lower end thereof a coupler which couples the bubble-chamber upper member to the bubble-chamber lower member 220. The bubble-chamber upper member 210 may include a coupled which protrudes downwards to be inserted into the bubble-chamber lower member 220.

The bubble-chamber upper member 210 may have a bubble-chamber outlet 211 through which the steam in the bubble chamber 210, 220 is discharged. The bubble-chamber outlet 211 may be a pipe which extends to the front of the bubble-chamber upper member 210.

One end of the bubble-chamber outlet 211 may communicate with the interior of the bubble chamber 210, 220, and the other end may communicate with the exterior of the bubble chamber 210, 220. The bubble-chamber outlet 211 may be coupled to the steam hose 190 to discharge the steam in the bubble chamber 210, 220 to the steam hose 190.

The bubble-chamber outlet 211 may be provided on an upper end of the bubble-chamber upper member 210, so that an upper surface of the bubble-chamber upper member 210 may be connected to an inner surface of the bubble-chamber outlet 211. Thereby, it is possible to reduce path resistance acting on steam flowing in the bubble chamber 210, 220.

An inner surface of the bubble-chamber outlet 211 which is connected to an inner surface of the bubble-chamber upper member 210 is rounded, thus ensuring smooth connection. Thereby, it is possible to reduce path resistance acting on steam introduced into the bubble-chamber outlet 211. Furthermore, stress acting on a portion at which the bubble-chamber outlet 211 and the bubble-chamber upper member 210 are connected is dispersed, thus improving durability.

The upper end of the bubble-chamber upper member 210 is inclined downwards towards the rear, so that it is possible to reduce path resistance acting on the flow of the steam introduced into the bubble-chamber outlet 211 in the bubble chamber 210, 220.

The bubble-chamber lower member 220 may be provided with the bubble-chamber inlet 221 through which wash water flows into the bubble chamber 210, 220. The bubble-chamber inlet 221 may be a pipe extending to the rear of the bubble-chamber lower member 220.

One end of the bubble-chamber inlet 221 may communicate with the interior of the bubble chamber 210, 220, and the other end may communicate with the exterior of the bubble chamber 210, 220. The bubble-chamber inlet 221 may be coupled to the wash pump 150, so that wash water in the wash pump 150 may be introduced into the bubble filter 200.

The bubble-chamber inlet 221 may be provided on the lower end of the bubble-chamber lower member 220, so that the lower surface of the bubble-chamber lower member 220 may be connected to the inner surface of the bubble-chamber inlet 221. Thereby, it is possible to reduce path resistance acting on wash water flowing in the bubble chamber 210, 220.

An inner surface of the bubble-chamber inlet 221 which is connected to an inner surface of the bubble-chamber lower member 220 is rounded, thus ensuring smooth connection. Thereby, it is possible to reduce path resistance acting on wash water flowing from the bubble-chamber inlet 221 into the bubble chamber 210, 220.

Furthermore, stress acting on a portion at which the bubble-chamber inlet 221 and the bubble-chamber lower member 220 are connected is dispersed, thus improving durability.

The bubble-chamber lower member 220 may have on an upper end thereof a coupler which couples the bubble-chamber lower member to the bubble-chamber upper member 210.

Referring to FIG. 7, the bubble-chamber lower member 220 may include the coupler 224 that is shaped to engage with the coupler 212 of the bubble-chamber upper member 210. The bubble-chamber upper member 210 may be partially inserted into the bubble-chamber lower member 220 to be coupled thereto. The bubble-chamber upper member 210 may be partially inserted into the interior of the bubble-chamber lower member 220 to be coupled thereto.

The bubble-chamber lower member 220 may be provided with a stopper 222 which guides the coupling height of the bubble-chamber upper member 210.

The stopper 222 may have the shape of a step formed on the upper end of the bubble-chamber lower member 220. The stopper 222 may be in contact with the lower end of the coupler 212 of the bubble-chamber upper member 210 to support the bubble-chamber upper member 210 upwards.

The bubble-chamber lower member 220 may include the coupler 224 which surrounds the outside of the coupler 212 of the bubble-chamber upper member 210. The coupler 224 may be connected to the stopper 222, thus covering the outside of the coupler 212 of the bubble-chamber upper member 210 seated on the stopper.

Thereby, the bubble-chamber upper member 210 and the bubble-chamber lower member 220 are provided in a crossing shape to be coupled to each other, thus sealing the bubble chamber 210, 220 so that fluid contained therein does not leak out from the bubble chamber 210, 220.

The bubble-chamber lower member 220 may include a pair of guide grooves 223*a* and 223*b* into which a pair of guide protrusions 234*a* and 234*b* that will be described later is inserted. The pair of guide grooves 223*a* and 223*b* may guide an insert position so that the bubble breaker 230 is vertically inserted.

The pair of guide grooves 223*a* and 223*b* may be formed on the inner surface of the bubble-chamber lower member 220, and be grooves which are recessed below the stopper 222.

The pair of guide grooves 223*a* and 223*b* may be provided on front and rear portions to face each other.

The bubble breaker 230 may be provided in the bubble chamber 210, 220 to be located higher than the water level in the bubble chamber 210, 220 while the dishwasher 1 is operated in the steam spray mode.

The dishwasher 1 may be set such that the water level in the sump 100 and the wash pump 150 in the steam spray mode is higher than the water level in the sump 100 and the wash pump 150 in the wash-water spray mode. The dishwasher 1 may be set such that the water level in the sump 100 and the wash pump 150 in the wash-water spray mode is lower than that in the steam spray mode, thus allowing the wash motor to effectively convey the wash water in the wash-water spray mode.

The bubble breaker 230 may be disposed higher than the water level of the wash water to break the bubble which is generated at the surface of the wash water and then introduced into the bubble breaker 230. Since the efficiency of the bubble breaker 230 may be reduced when a portion of the bubble breaker 230 sinks in the wash water, the bubble breaker 230 is preferably disposed higher than the water level of the wash water.

The bubble breaker 230 may be formed of a material having low strain at high temperature. The bubble breaker 230 may be formed of a material that may withstand steam or bubble heated to 100 degrees or higher. The bubble breaker 230 may be formed of a material whose heat conductivity is a predetermined level or less. The bubble breaker 230 may be formed of a material whose thermal expansion coefficient is a predetermined level or less.

Thereby, it is possible to prevent the bubble breaker 230 from being deformed by heat and changed in placement in the bubble chamber 210, 220. Alternatively, it is possible to prevent the bubble breaker 230 from expanding and thereby prevent the bubble chamber 210, 220 from being damaged.

Referring to FIGS. 4 and 8, the bubble breaker 230 may include a plurality of breaking plates 231*a*, 231*b*, 231*c*, and 231*d* extending in a direction where steam flows in the bubble chamber 210, 220. The steam in the bubble chamber 210, 220 may flow from bottom to top along the vertically extending bubble chamber 210, 220.

The plurality of breaking plates 231*a*, 231*b*, 231*c*, and 231*d* may be provided in the shape of a plate having a thickness. The plurality of breaking plates 231*a*, 231*b*, 231*c*, and 231*d* may be formed to have a predetermined thickness.

The plurality of breaking plates 231*a*, 231*b*, 231*c*, and 231*d* may be formed to have a smooth surface.

Although not shown in the drawings, protrusions may be formed on surfaces of the plurality of breaking plates 231*a*, 231*b*, 231*c*, and 231*d*, thus increasing a contact surface between the bubble and each breaking plate. Thereby, the bubble may be more effectively broken.

Contact surfaces of left and right sides of each of the breaking plates 231*a*, 231*b*, 231*c*, and 231*d* coming into contact with the bubble may be formed of a hydrophilic material. Thereby, when the bubble comes into contact with the contact surface of each of the breaking plates 231*a*, 231*b*, 231*c*, and 231*d*, the bubble may be easily burst.

The plurality of breaking plates 231*a*, 231*b*, 231*c*, and 231*d* may be arranged in a front-rear direction or a left-right direction so that neighboring breaking plates 231*a*, 231*b*, 231*c*, and 231*d* face each other. Spaces in which steam flows may be formed between neighboring breaking plates 231*a*, 231*b*, 231*c*, and 231*d*.

The plurality of breaking plates 231*a*, 231*b*, 231*c*, and 231*d* may be arranged to be spaced apart from each other by a predetermined interval.

For example, the plurality of breaking plates 231*a*, 231*b*, 231*c*, and 231*d* may be arranged to be spaced apart from each other by the interval of 3 to 5 mm.

Thereby, it is possible to prevent a bubble exceeding a predetermined size from passing between the breaking plates 231*a*, 231*b*, 231*c*, and 231*d*, and to limit the inflow of wash water between the plurality of breaking plates 231*a*, 231*b*, 231*c*, and 231*d*.

Among the plurality of breaking plates 231*a*, 231*b*, 231*c*, and 231*d*, the breaking plates 231*a* and 231*d* adjacent to the inner surface of the bubble chamber 220 are disposed to be spaced apart from the inner surface of the bubble chamber 220 by a predetermined distance, so that the steam flow space may be formed between the breaking plates 231*a* and 231*d* and the inner surface of the bubble chamber 220.

When the breaking plates 231*a* and 231*d* adjacent to the inner surface of the bubble chamber 220 are provided to be in contact with the inner surface of the bubble chamber 220, only one of both contact surfaces of the breaking plates 231*a* and 231*d* comes into contact with the bubble, thus reducing bubble removal efficiency. Therefore, the breaking plates 231*a* and 231*d* are disposed to be spaced apart from the inner surface of the bubble chamber 220, so that both contact surfaces of the plurality of breaking plates 231*a*, 231*b*, 231*c*, and 231*d* may come into contact with the bubble.

The bubble breaker 230 may include a first connecting plate 232 connecting first sides of the plurality of breaking plates 231*a*, 231*b*, 231*c*, and 231*d* to each other. The bubble breaker 230 may include a second connecting plate 233 connecting second sides of the plurality of breaking plates 231*a*, 231*b*, 231*c*, and 231*d* to each other.

The first connecting plate 232 may be connected to a front end of each of the plurality of breaking plates 231*a*, 231*b*, 231*c*, and 231*d*. The first connecting plate 232 may be formed to have a predetermined thickness in the front-rear direction, and extend vertically.

The first connecting plate 232 may be provided with a surface which is in contact with the inner surface of the bubble chamber 210, 220. The first connecting plate 232 may be formed in a shape corresponding to the curvature of the inner surface of the bubble chamber 210, 220 to be in close contact with the inner surface of the bubble chamber 210, 220.

The second connecting plate 233 may be connected to a rear end of each of the plurality of breaking plates 231*a*, 231*b*, 231*c*, and 231*d*. The second connecting plate 233 may be formed to have a predetermined thickness in the front-rear direction, and extend vertically.

The second connecting plate 233 may be provided with a surface which is in contact with the inner surface of the bubble chamber 210, 220. The second connecting plate 233 may be formed in a shape corresponding to the curvature of the inner surface of the bubble chamber 210, 220 to be in close contact with the inner surface of the bubble chamber 210, 220.

The bubble breaker 230 may have a pair of guide protrusions 234*a* and 234*b* on both sides facing each other. The pair of guide protrusions 234*a* and 234*b* may be provided on the first connecting plate 232 and the second connecting plate 233, respectively.

The first guide protrusion 234*a* may protrude forwards from the first connecting plate 232.

A vertical length of the first guide protrusion 234*a* may be formed to correspond to a vertical length of the guide groove 223*a*. For example, the vertical length of the first guide protrusion 234*a* may be smaller than or equal to the vertical length of the guide groove 223*a*.

A horizontal length of the first guide protrusion 234*a* may be formed to correspond to a horizontal length of the guide groove 223*a*. For example, the horizontal length of the first guide protrusion 234*a* may be smaller than or equal to the horizontal length of the guide groove 223*a*.

A protruding length of the first guide protrusion 234*a* in the front-rear direction may be formed to correspond to a recessed depth of the guide groove 223*a* in the front-rear direction. For example, the length of the first guide protrusion 234*a* in the front-rear direction may be formed to be smaller than or equal to the length of the guide groove 223*a* in the front-rear direction.

The second guide protrusion 234*b* may be provided to be symmetrical with the first guide protrusion 234*a*. The second guide protrusion 234*b* and the first guide protrusion 234*a* may be symmetrical with each other in the front-rear direction.

The second guide protrusion 234*b* may protrude forwards from the second connecting plate 233.

A vertical length of the second guide protrusion 234*b* may be formed to correspond to a vertical length of the guide groove 223*b*. For example, the vertical length of the second guide protrusion 234*b* may be smaller than or equal to the vertical length of the guide groove 223*b*.

A horizontal length of the second guide protrusion 234*b* may be formed to correspond to a horizontal length of the guide groove 223*b*. For example, the horizontal length of the second guide protrusion 234*b* may be smaller than or equal to the horizontal length of the guide groove 223*b*.

A protruding length of the second guide protrusion 234*b* in the front-rear direction may be formed to correspond to a recessed depth of the guide groove 223*b* in the front-rear direction. For example, the length of the second guide protrusion 234*b* in the front-rear direction may be formed to be smaller than or equal to the length of the guide groove 223*b* in the front-rear direction.

Referring to FIG. 7, a thickness of the coupler 212 of the bubble-chamber upper member 210 is formed to be greater than a width of the stopper 222 of the bubble-chamber lower member 220, so that the coupler may protrude inwards further than the inner surface of the stopper 222.

A portion of the coupler 212 of the bubble-chamber upper member 210 which protrudes inwards further than the inner surface of the stopper 222 may support the guide protrusions 234*a* and 234*b* of the bubble breaker 230 downwards.

Thereby, the bubble breaker 230 may be secured in place while being vertically supported by the bubble-chamber upper member 210 and the bubble-chamber lower member 220.

Figure 9:
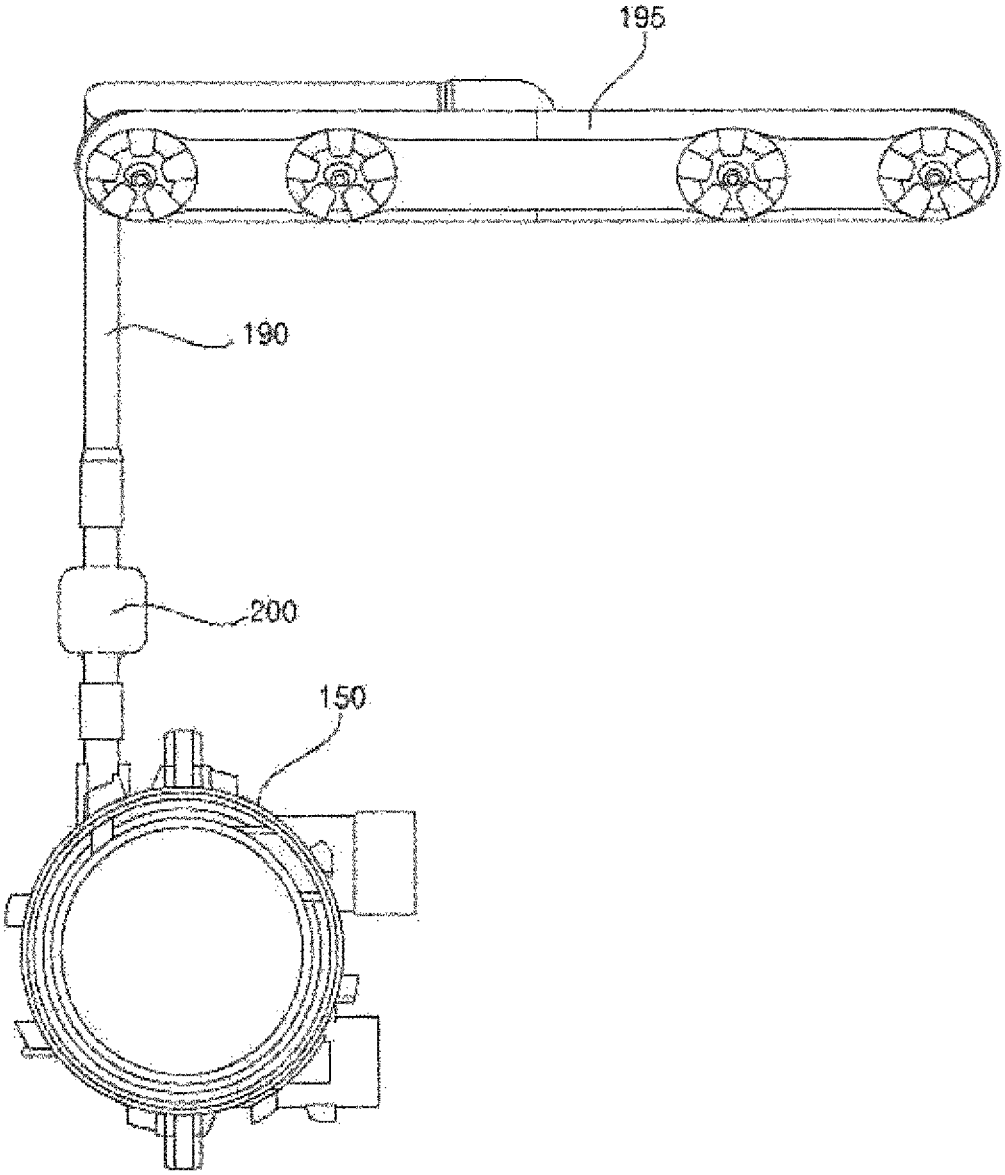
FIGS. 9 and 10 are diagrams illustrating a portion of the configuration of the dishwasher in accordance with the embodiment of the present disclosure.
Figure 10:
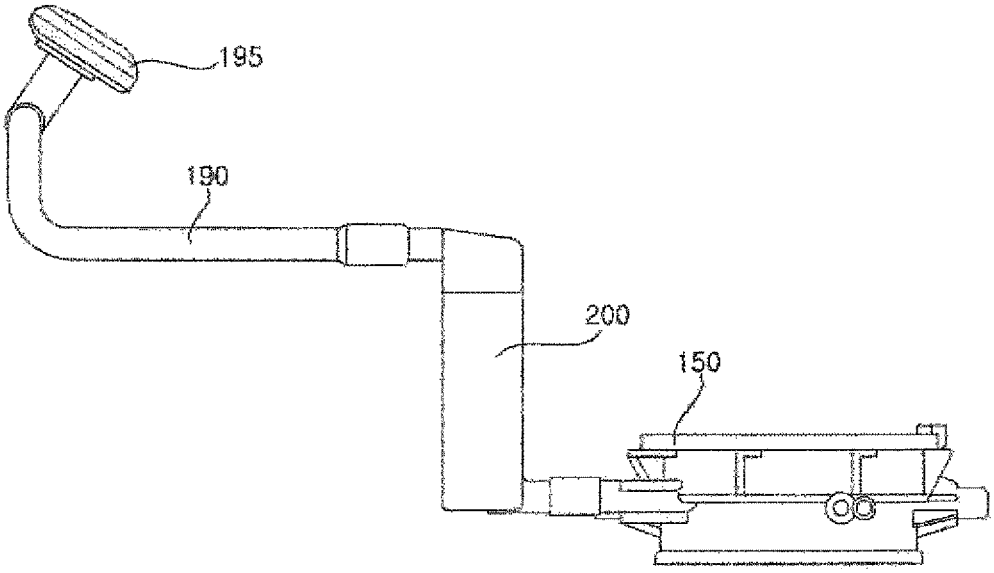

FIGS. 9 and 10 are diagrams illustrating a portion of the configuration of the dishwasher in accordance with the embodiment of the present disclosure.

Referring to FIGS. 9 and 10, the bubble filter 200 may be connected at a lower end thereof to the wash pump 150, and connected at an upper end thereof to the steam hose 190.

The bubble filter 200 may be coupled to the discharge pipe of the wash pump 150. The discharge pipe of the wash pump 150 may be a pipe communicating with the steam nozzle 195.

The bubble filter 200 may be coupled to the wash pump 150 by a separate fastening member. The fastening member may be coupled while surrounding an inlet pipe of the bubble filter 200 and the discharge pipe of the wash pump 150.

The bubble filter 200 may be disposed in a vertical direction that is the same as the gravity direction of the bubble chamber 210, 220, thus preventing the bubble chamber 210, 220 from being tilted to one side and thereby preventing the wash water in the bubble chamber 210, 220 from coming into contact with the bubble breaker 230.

The bubble filter 200 may be disposed on a base 11*a* of the case 11 on which the sump 100 and the wash pump 150 are disposed.

The bubble filter 200 may be disposed to be spaced apart from other components adjacent to the bubble chamber outlet 211 by a predetermined distance or more. For example, the bubble filter 200 may be disposed in the base 11*a* so that other components of the dishwasher 1 are not located within 14 mm from an end of the bubble chamber outlet 211.

Thereby, it is possible to secure a space for coupling the bubble chamber outlet 211 to the steam hose 190.

Meanwhile, the bubble filter 200 configured as such may minimize the curve part in the steam path, thus minimizing a pressure loss.

When the steam hose 190 connects the wash pump 150 and the steam nozzle 195 without the bubble filter 200, the steam hose 190 includes a plurality of bent curve parts. The curved path is a point in which a difference in rotating radius of fluid flowing along the path is large, and may have a larger hydraulic loss compared to a straight path.

Since the bubble filter 200 is connected to the wash pump 150 and steam is created in the bubble filter 200, the flow distance of the steam may be reduced, and in addition, the number of curved paths may be reduced.

By way of example, since the bubble-chamber inlet 221 of the bubble-chamber lower member 220 is formed in a curved path and steam is formed in the middle of the bubble chamber 210, 220, the steam does not pass through the bubble-chamber inlet 221 and the bubble-chamber lower member 220 and the number of the curve parts of the steam path may be reduced.

The dishwasher 1 may be set such that the water level in the water collector 102, the wash pump 150, and the bubble chamber 210, 220 is above a certain height in the steam spray mode. In the state where wash water is stored in the bubble chamber 210, 220, the wash water may be heated by the heater 140, thus generating steam. When the wash water reaches 100 degrees in the bubble chamber 210, 220, the steam may be generated. At this time, the steam may be generated at the surface of the wash water.

Therefore, as the level of the wash water increases, a distance the generated steam moves to the steam nozzle may be reduced. In the state where the level of the wash water in the bubble chamber 210, 220 of the bubble filter 200 is above a certain height, steam may be effectively generated.

Although the present disclosure was described with reference to specific embodiments, it is apparent to those skilled in the art that the present disclosure may be changed and modified in various ways without departing from the scope of the present disclosure, which is described in the following claims.

| [Description of reference numerals] | |
|---|---|
| 1: dishwasher | 11: case |
| 12: tub | 16, 17: rack |
| 20: door | 100: sump |
| 130: switch valve | 23: water supply path |
| 24: drain path | 26: filter |
| 13, 14, 15: a plurality of spray arms | |
| 18, 19, 21: a plurality of spray-arm connecting paths | |
| 140: heater | 150: wash pump |
| 170: water collecting path | 175: check valve |
| 180: wash-water supply path | 190: steam hose |
| 195: steam nozzle | 200: bubble filter |

What is claimed is:

1. A dishwasher, comprising:

a case accommodating a cleaning target therein;

a sump connected to an interior of the case to collect wash water;

a wash pump into which the wash water flows from the sump, and generating steam;

a steam nozzle into which the steam flows from the wash pump, and spraying the steam into the case; and a bubble filter disposed on a steam path between the wash pump and the steam nozzle to remove a bubble in the steam path.

2. The dishwasher of claim 1, wherein the bubble filter comprises:

a bubble chamber configured such that a first end thereof is located to be higher than a water level in the wash pump, and a second end thereof is located to be lower than the water level in the wash pump, while the dishwasher is operated in a steam spray mode, and a bubble breaker disposed in the bubble chamber to break the bubble.

3. The dishwasher of claim 2, wherein the bubble breaker is disposed higher than the water level in the wash pump, while the dishwasher is operated in the steam spray mode.

4. The dishwasher of claim 3, wherein the bubble breaker comprises a plurality of breaking plates extending in a direction where the steam flows in the bubble chamber, the plurality of breaking plates being arranged such that neighboring breaking plates face each other, with a steam flow space being formed between the neighboring breaking plates.

5. The dishwasher of claim 4, wherein the bubble breaker forms the steam flow space between a breaking plate adjacent to an inner surface of the bubble chamber among the plurality of breaking plates and the inner surface of the bubble chamber.

6. The dishwasher of claim 4, wherein the bubble breaker comprises a pair of guide protrusions on both sides thereof that face each other, and the bubble chamber comprises a pair of guide grooves into which the pair of guide protrusions is inserted, so that the bubble breaker is slidably coupled to the bubble chamber.

7. The dishwasher of claim 6, wherein the bubble breaker comprises a first connecting plate connecting first sides of the plurality of breaking plates to each other, and a second connecting plate connecting second sides of the plurality of breaking plates to each other, and each of the first connecting plate and the second connecting plate comprises a guide protrusion.

8. The dishwasher of claim 6, wherein the bubble chamber comprises a bubble-chamber upper member and a bubble-chamber lower member, and the bubble breaker is disposed between a bubble-chamber upper member and a bubble-chamber lower member, is supported upwards by the bubble-chamber lower member, and is supported downwards by the bubble-chamber upper member.

9. The dishwasher of claim 1, further comprising:

a steam hose connecting the bubble filter and the steam nozzle, wherein the bubble filter is coupled at a first end thereof to the wash pump, and coupled at a second end thereof to the steam hose.

10. The dishwasher of claim 1, wherein the bubble filter is disposed on a base of the case, on which the sump and the wash pump are disposed.

* * * * *